United States Patent [19]

Frick et al.

[11] Patent Number: 4,909,160

[45] Date of Patent: Mar. 20, 1990

[54] TEMPERATURE-CONTROLLED EXHAUST PARTICULATE COLLECTION SYSTEM FOR HIGH TEMPERATURE MATERIAL PROCESSING FACILITY

[75] Inventors: Ronald J. Frick, Kendallville; John L. Luttman, Orland; William K. Blaskie, Rome City, all of Ind.

[73] Assignee: ETA Engineering, Inc., Kendallville, Ind.

[21] Appl. No.: 261,772

[22] Filed: Oct. 24, 1988

[51] Int. Cl.[4] ..... F23N 5/00

[52] U.S. Cl. ..... 110/185; 55/227; 55/341.4; 110/211; 110/215; 110/216; 110/191

[58] Field of Search ..... 110/210, 211, 215, 216, 110/191, 185; 55/227, 341.4

[56] References Cited

U.S. PATENT DOCUMENTS

| | | | |
|---|---|---|---|
| 1,806,513 | 5/1931 | Scharina | 55/341.4 |
| 2,840,454 | 6/1958 | Tomlinson et al. | 23/48 |
| 2,871,978 | 2/1959 | Webster et al. | 183/57 |
| 3,395,510 | 8/1968 | Barnes | 55/227 X |
| 3,568,415 | 3/1971 | Wyrough | 55/302 |
| 3,608,278 | 9/1971 | Greenspan | 55/212 |
| 3,668,833 | 6/1972 | Cahill, Jr. | 110/215 X |
| 3,695,004 | 10/1972 | De Lisio et al. | 55/227 X |
| 3,767,536 | 10/1973 | Ikeda et al. | 202/263 |
| 3,782,074 | 1/1974 | Gardenier | 55/19 |
| 3,884,162 | 5/1975 | Schuster | 110/215 X |
| 3,948,623 | 4/1976 | Ostby et al. | 55/96 |
| 4,110,088 | 8/1978 | Cold et al. | 55/90 |
| 4,157,901 | 6/1979 | Schaltenbrand | 55/302 |
| 4,251,236 | 2/1981 | Fattinger et al. | 55/84 |
| 4,289,511 | 9/1981 | Johnson, Jr. | 55/302 |
| 4,314,830 | 2/1982 | Skiven et al. | 55/217 |
| 4,642,127 | 2/1987 | Ando et al. | 55/20 |
| 4,827,855 | 5/1989 | Koptis et al. | 110/190 X |

*Primary Examiner*—Edward G. Favors

*Attorney, Agent, or Firm*—Jeffers, Hoffman & Niewyk

[57] ABSTRACT

A temperature-controlled exhaust particulate collection system used with a high temperature material processing facility has a serial arrangement of devices in the form of a spray cooler, spark arrester and dust collector which receive the particulate-laden exhaust gas flow from the facility and operate to separate and collect the particulates from the gas flow before venting to atmosphere. The collection system also has control devices in the form of temperature sensors or thermocouples, valves and dampers whose respective functions are to monitor and control operations of the collection system. The thermocouples sense temperatures at strategically located points in the exhaust gas flow, and the valves and dampers regulate operation of the facility and the spray cooler, spark arrester and dust collector in response to the temperatures sensed by the thermocouples to maintain the temperatures at or below predetermined limits and to protect the latter from temperature-induced damage.

21 Claims, 4 Drawing Sheets

TEMPERATURE-CONTROLLED EXHAUST PARTICULATE COLLECTION SYSTEM FOR HIGH TEMPERATURE MATERIAL PROCESSING FACILITY

BACKGROUND OF THE INVENTION

The present invention generally relates to air pollution control and, more particularly, is concerned with a temperature-controlled exhaust particulate collection system for use with a high-temperature material processing facility, for example, a furnace typically used in an industrial foundry.

In many industries, and particularly those which employ high-temperature material processing facilities, such as furnaces and incinerators, there exists the problem of removing suspended solid particulates from the flow of exhaust gases which is to be vented to the atmosphere. Clean air standards are mandating the removal of these particulates from the vented gases to reduce pollution of the atmosphere.

It has become conventional practice to employ some type of particulate filtration and collection system with such high-temperature facilities to remove the solid pollutants from the flue or exhaust gases. Representative of systems found in the prior art are the ones disclosed in U.S. Pat. No. (2,840,454) to Tomlinson et al, Webster et al (U.S. Pat. No. 2,871,987), Wyrough (U.S. Pat. No. 3,568,415), Greenspan (U.S. Pat. No. 3,608,278), Ikeda et al (U.S. Pat. No. 3,767,536), Gardenier (U.S. Pat. No. 3,782,074), Ostby et al (U.S. Pat. No. 3,948,623), Cold et al (U.S. Pat. No. 4,110,088), Schaltenbrand (U.S. Pat. No. 4,157,901), Fattinger et al (U.S. Pat. No. 4,251,236), Johnson, Jr. (U.S. Pat. No. 4,289,511), Skiven et al (U.S. Pat. No. 4,314,830) and Ando et al (U.S. Pat. No. 4,642,127).

As shown in the above-cited prior art, it is also conventional practice to use a serial arrangement of various types of devices to filter and collect the suspended particulates from the gaseous flow before venting it to the atmosphere. For example, Webster et al disclose a system for removing solids from waste gases which has a quench tower connected to the outlet of a reactor, and a precipitator, cyclone separator and bag filter serially connected downstream from the quench tower.

Further, in those systems where bag filters are used, some means is typically provided for cleaning them. Johnson, Jr., Schaltenbrand and Wyrough disclose devices having a series of nozzles for supplying pressurized air to the interiors of the bags to dislodge collected particulate material from the exteriors thereof. Other cleaning devices are known which shake the bags to dislodge particulate material collected on the interiors thereof.

From the above-cited prior art, it can be deduced that an extensive amount of development effort has gone into particulate filtration and collection systems for the purpose of reducing air pollution by industrial material processing facilities. However, a system approaching optimum has yet been deviced and many current systems have major drawbacks in their reliability and temperature controls. Consequently, a need still exists for improvements in particulate collection system design to eliminate these drawbacks.

SUMMARY OF THE INVENTION

The present invention provides a temperature-controlled exhaust particulate collection system designed to satisfy the aforementioned needs. The particulate collection system of the present invention is coupled to a high-temperature material processing facility and incorporates a serial arrangement of devices which receive a particulate-laden exhaust gas flow from the facility and are operable for separating and collecting the particulates from the gas flow before venting to atmosphere. Also, the system includes an arrangement of control devices operable for sensing temperatures at strategically located points in the gas flow and for regulating operation of the separating and collecting devices in response to the temperatures sensed to maintain the temperatures at or below predetermined limits.

Further, upon the occurrence of a system malfunction, the control devices function to monitor the operation of the separating and collecting devices of the system and provide an early warning to an operator of possible malfunctions. If the onset of a malfunction is sudden allowing insufficient time for operator intervention, the devices will function to cause gas flow to bypass the separating and collecting devices of the system to protect them from damage while allotting time for undertaking an investigation of the malfunction and possible correction thereof without shutdown of the material processing facility or, alternatively, for permitting an orderly shutdown. The coordinated and comprehensive approach to temperature control employed by the particulate collection system of the present invention improves its operational reliability in removing pollutants and safeguards its separating and collecting devices from temperature-induced damage.

Accordingly, the present invention is directed to a temperature-controlled exhaust particulate collection system coupled to a high temperature material processing facility producing a particulate-laden exhaust gas flow. The facility has an afterburner operable at a minimum temperature for combusting gaseous by-products in the exhaust gas flow. The collection system comprises: a plurality of devices for receiving the exhaust gas flow from the facility and for separating and collecting particulates therefrom prior to release of the exhaust gas flow to the atmosphere; a plurality of gas flow ducts interconnecting the devices so as to arrange the devices in series and in flow communication with one another and with the exhaust gas flow from the facility; and means for inducing movement of the exhaust gas flow from the facility through the gas flow ducts and the separating and collecting devices.

Also, the collection system, in accordance with one form of the invention, includes means coupled to the afterburner of the facility and to one of the ducts for sensing the temperature of the exhaust gas flow downstream of the facility and upstream of a first one of the devices and for controlling operation of the afterburner in response to the temperature sensed so as to maintain afterburner operation at least at the minimum temperature.

Further, the collection system includes a damper coupled in flow communication to one of the ducts upstream of one device having filter bags and being operable for permitting entering and mixing of a cooling gas into the exhaust gas flow to reduce the temperature thereof. Also, sensors are coupled to one of the ducts for sensing the temperature of the exhaust gas flow downstream of the facility and upstream of the filtering device for controlling operation of the cooling gas entering and mixing means to permit the cooling gas to enter and mix with the exhaust gas flow to reduce the temperature thereof in response to the temperature sensed being above a preset maximum temperature.

Still further, the collection system includes a flow diverter coupled to the duct connected to an inlet of the filtering device operable for permitting the exhaust gas flow to by-pass the filtering device.

Yet further, the collection system includes a spray cooler located immediately downstream of the facility for spraying water on the exhaust gas flow as it passes through the spray cooler. Also, means are coupled to one of the ducts for sensing the temperature of the exhaust gas flow immediately downstream of the spray cooler and for controlling operation of the cooler in response to the temperature sensed being above a preset maximum temperature.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1A:
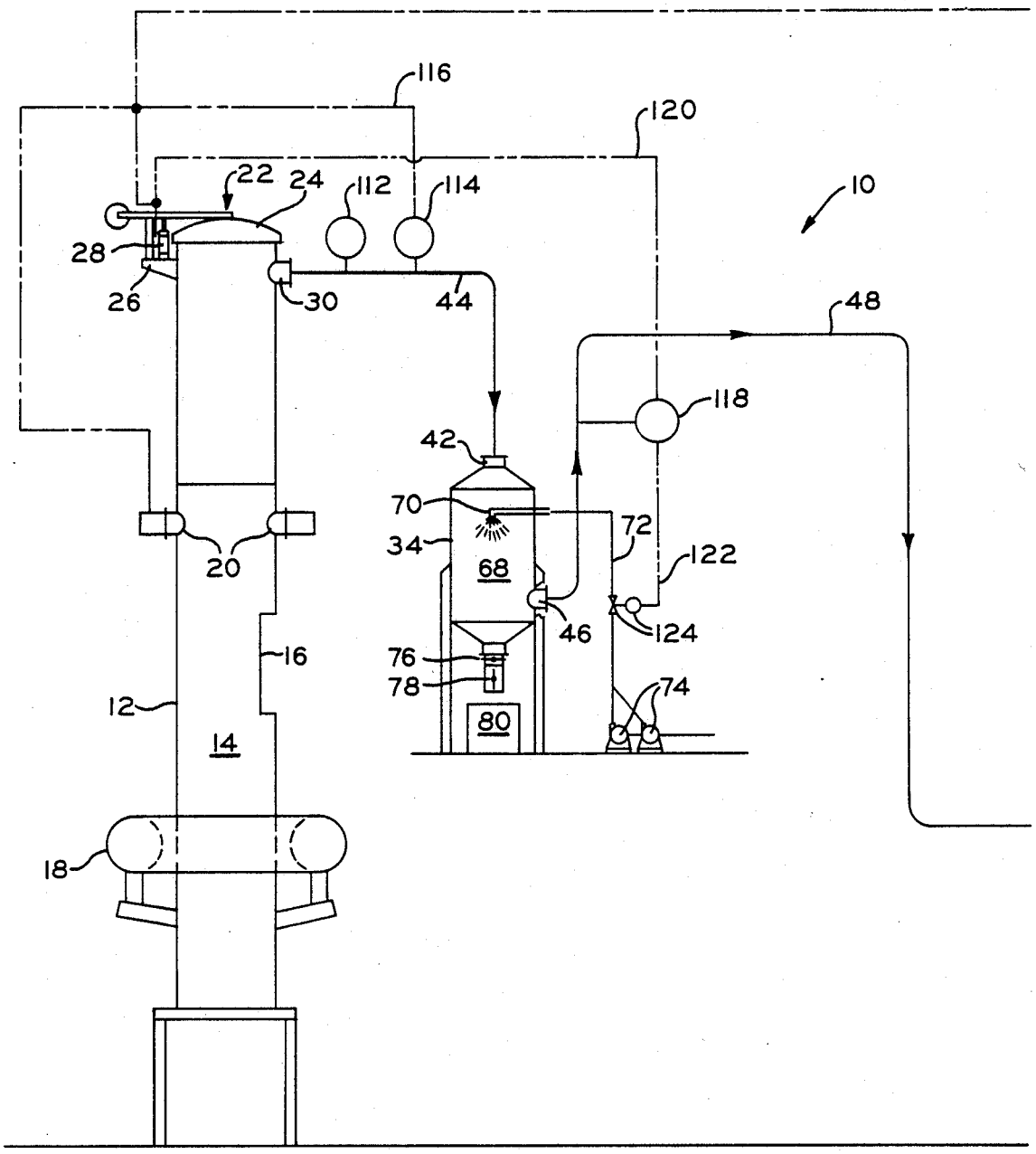
FIGS. 1A and 1B are an elevational view, in schematic form, of a temperature-controlled exhaust particulate collection system employed with a material processing facility in accordance with the principles of one form of the present invention.
Figure 1B:
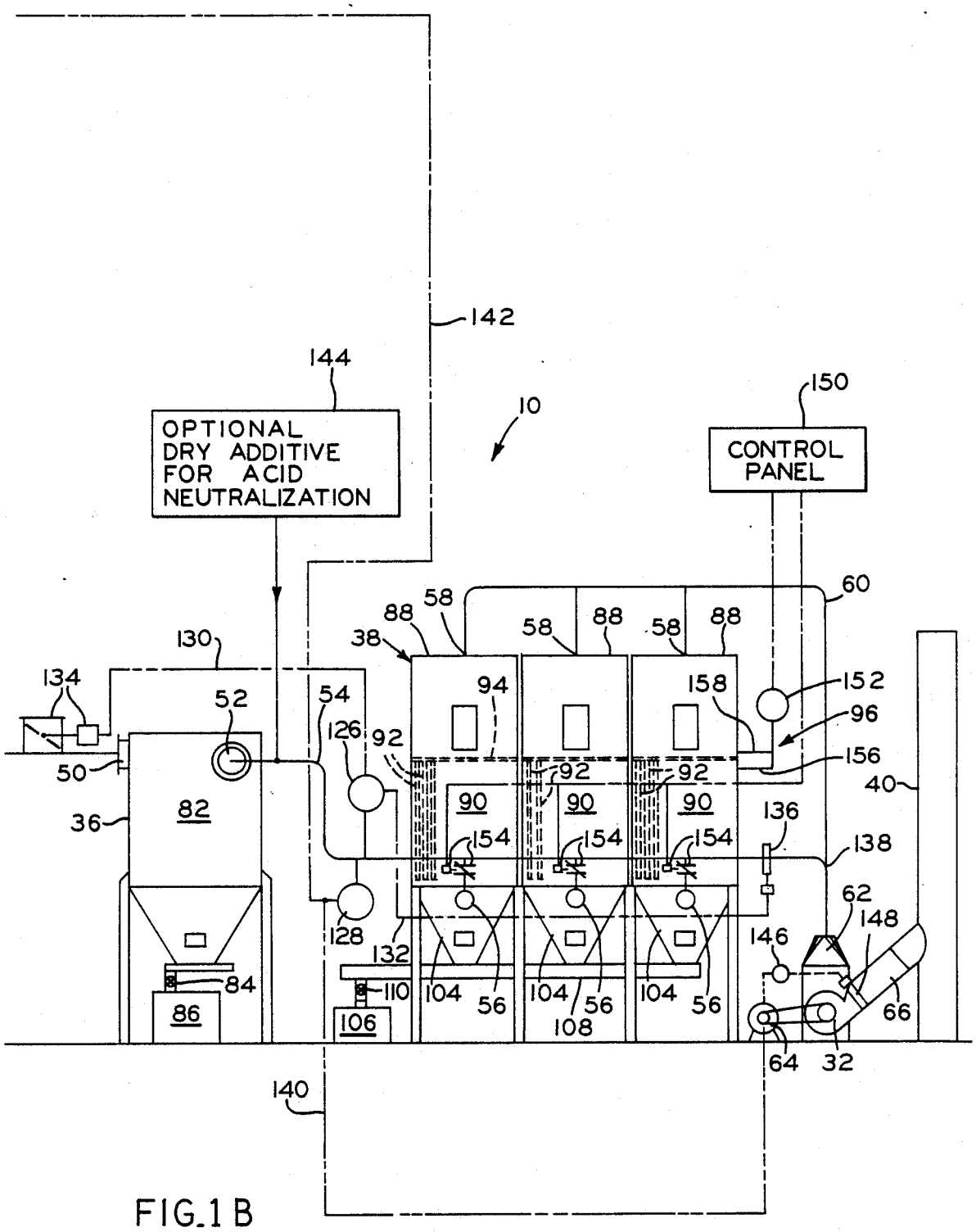

Referring now to the drawings, FIGS. 1A and 1B show a temperature-controlled exhaust particulate collection system of the present invention, generally designated 10, which is employed with a material processing facility, for example a foundry melting furnace 12 commonly known as a cupola melter. The particulate collection system 10 performs monitor and control operations in accordance with the flow charts depicted in FIGS. 3-5 to minimize release into the atmosphere of particulate produced by the melting furnace 12.

The furnace 12 typically has an elongated internal combustion chamber 14 and a charge door 16 through which materials, such as iron, coke, limestone, scrap metals, etc., are delivered and deposited in layered form in the lower portion of the combustion chamber 14. Also, the furnace 12 has an air header 18 through which air flows into the combustion chamber 14 and an afterburner 20 in the upper portion of the combustion chamber 14 which burns natural gas or propane for finishing combustion of gaseous by-products of combustion flowing upward from the lower portion of the combustion chamber 14.

Further, a closure cap assembly 22 is provided on the top of the furnace 12. The cap assembly 22 includes a circular lid 24 pivotally mounted on the furnace 10 by a support structure 26 and an actuator 28 in the form of a hydraulic or air cylinder for pivotally moving the lid 24 between a lifted open position and a lowered closed position in which the lid is normally disposed covering the upper open end of the furnace 12. Below its upper end, the furnace 12 has an exhaust port 30.

As illustrated schematically in FIGS. 1A and 1B, the temperature-controlled exhaust particulate collection system 10 of the present invention is coupled to the furnace 12 and basically includes an air flow inducing blower or fan 32 and a serial arrangement of a spray cooler 34, a spark arrester 36 and a dust collector 38 between the fan 32 and the furnace 12 for receiving a particulate-laden exhaust gas flow from the furnace 12. The spray cooler 34, spark arrester 36 and dust collector 38 are basically operable for separating and collecting a substantial fraction of particulates from the furnace exhaust gas flow before reaching the fan 32 and venting to the atmosphere via a discharge stack 40 connected to the fan.

More particularly, spray cooler 34 has an inlet port 42 connected in flow communication by a first duct 44 with the furnace exhaust port 30 and an outlet port 46 connected in flow communication by a second duct 48 with an inlet port 50 of the spark arrester 36. The spark arrester 36, in turn, has an outlet port 52 connected in flow communication by a third duct 54 with a plurality of inlet ports 56 of the dust collector 38. The dust collector 38 has a corresponding plurality of outlet ports 58 connected in flow communication by a fourth duct 60 to an inlet port 62 of the fan 32. The fan 32 is operated by a suitable source of power such as an electric motor 64 connected by an outlet duct 66 to the lower portion of the discharge stack 40.

Further, the spray cooler 34 of the particulate collection system 20 has an interior chamber 68 with a series of water atomizing nozzles 70 connected in flow communication by a conduit 72 to one or more cooling water pumps 74. In the spray cooler 34, the velocity of the particulate-laden exhaust gas flow through the chamber 68 between the inlet and outlet ports 42, 46 is reduced due to the large volume of the chamber 68 and concurrently is cooled by the water spray emanating from the nozzles 70. At the bottom of the chamber 68, the spray cooler 34 includes a pair of upper and lower valves 76, 78 in a vertical tandem arrangement which are operated periodically to permit passage and collection in a bin 80 of particulates primarily of larger sizes separated from the exhaust gas flow by the spray cooler 34. In order to maintain proper pressure in the system 10, the valves 76, 78 are opened at separate intervals to provide an air lock. For example, the upper valve 76 is opened with the lower valve 78 closed to allow passage of the separated particulates through the upper valve. Then the upper valve 76 is closed and the lower valve 78 is opened to allow passage of the separated particulates through it to the collection bin 80.

The spark arrester 36 of the particulate collection system 10 has an interior chamber 82 which can be a cyclone type that causes the exhaust gas flow to swirl therein in traveling from its inlet port 50 to outlet port 52. At the bottom of the chamber 82, the spark arrester 36 includes a pair of air lock valves 84 similar to those of the spray cooler 34 which likewise are periodically operated to permit passage of separated particulates to a bin 86. The primary purpose of the spark arrester 36 is to separate out spark-bearing particulates and others that might have happened to pass through the spray cooler 34 which remain hot enough to have the potential to create a fire in the dust collector 38.

The dust collector 38 of the particulate collection system 10 preferably rises several collection modules 88 each having an internal chamber 90 with the inlet and outlet ports 56, 58 at respective lower and upper ends thereof. The chambers 90 of the respective modules 88 connected at their respective inlet and outlet ports 56, 58 to the spark arrester 36 via the third duct 54 and to the fan 32 via the fourth duct 60 define separate flow paths for the exhaust gas flow through the dust collector 38.

Figure 2:
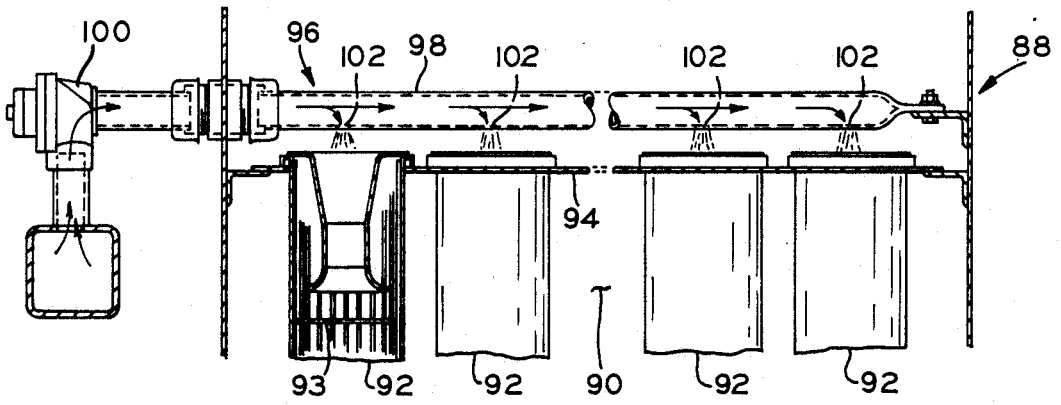
FIG. 2 is an enlarged fragmentary view of a portion of the dust collector and filter bag cleaning device of the particulate collection system of FIGS. 1A and 1B.

As seen in FIG. 2 as well as in FIGS. 1A and 1B, each module 88 contains a plurality of filter bags 92 in its chamber 90 which are internally supported to prevent collapse by elongated cage structures 93 and are suspended vertically from an upper horizontal support plate 94 extending across the top of the chamber 90. In the embodiment illustrated in FIGS. 1A, 1B and 2, the exhaust gas flow travels from the inlet ports 56 upwardly along the exterior of the bags 92 and through the bags into the interior thereof and therefrom out through the support plate 94 to the outlet ports 58 such that any remaining particulates in the flow collects on the exterior surfaces of the bags. Alternatively, the arrangement could be the opposite wherein the exhaust gas flow travels upwardly along the interior of the bags and through the bags into the exterior thereof in which case the particulates collect on the interior surfaces of the bags.

As seen in FIG. 2, a bag cleaning device 96 is provided in conjunction with the dust collector 38 which includes a manifold 98 connected to a source of pressurized air through a valve 100. The manifold 98 has a series of nozzles 102 aligned with the upper open ends of the bags 92 and supplies pulses of the pressurized air to the interiors of the bags from above to dislodge collected particulates from the exteriors thereof. In the above-mentioned alternative arrangement, a different cleaning device can be used which shakes the bags to dislodge particulate material collected on the interiors thereof. Regardless of which cleaning device is used, hoppers 104 are respectively located at the lower ends of the collection module chambers 90 for receiving the dislodged particulates. The particulates are routed to a bin 106 via a screw conveyor 108 and air lock valves 110, which operate similar to the valves associated with the spray cooler 34 and spark arrester 36.

Basically, what has been described up to this point with respect to the particulate collection system 10 is its serial arrangement of devices, namely, the spray cooler 34, spark arrester 36 and dust collector 38, which receive the particulate-laden exhaust gas flow from the furnace 12 and operate to separate and collect the particulates from the gas flow before venting to atmosphere. What will now be described with respect to the particulate collection system 10 are its different groups of control devices, as also seen schematically in FIGS. 1A and 1B, in the form of temperature sensors, valves and dampers whose respective functions will be described later in detail with reference to the monitor and control operations depicted in flow charts of FIGS. 3–5. In general, thermocouples are operable for sensing temperatures at strategically located points in the exhaust gas flow, and the valves and dampers are operable for regulating operation of the particulate separating and collecting spray cooler 34, spark arrester 36 and dust collector 38 in response to the temperatures sensed by the thermocouples to maintain the temperatures at or below predetermined limits and to protect the latter from temperature-induced damage.

More particularly, first and second thermocouples 112, 114 are coupled to the first duct 44 for sensing the temperature of the exhaust gas flow therein downstream of the furnace exhaust port 30 and upstream of the spray cooler inlet port 42. The first thermocouple 112 is used merely to record and inform the operator of the spray cooler inlet temperature. The second thermocouple 114 is connected via line 116 to control the operating temperature of the furnace afterburner 20.

A third thermocouple 118 is coupled to the second duct 48 for sensing the temperature of the exhaust gas flow therein downstream of the spray cooler outlet port 46 and upstream of the spark arrester inlet port 50. The third thermocouple 118 is connected via lines 120, 122 respectively to control operation of the actuator 28 of the closure cap assembly 22 in opening or closing its lid 24 and to control operation of a valve 124 coupled in the conduit 72 to regulate cooling water flow from the water pumps 74 to the atomizing nozzles 70 within the spray cooler chamber 68.

Fourth and fifth thermocouples 126, 128 are coupled to the third duct 54 for sensing the temperature of the exhaust gas flow therein downstream of the spark arrester outlet port 52 and upstream of the dust collector inlet ports 56. The fourth thermocouple 126 is connected via lines 130, 132 respectively to control operation of an air bleed damper 134 coupled to the second duct 48 immediately upstream of the spark arrester inlet port 50 and to control operation of a by-pass damper 136 coupled to the third duct 54 downstream of the dust collector inlet ports 56 and upstream of a connection at 138 of the third and fourth ducts 54, 60. Because of the negative pressure in the second duct 48 induced by operation of the fan 32, the damper 134 operates to regulate the amount o cooler atmospheric air that is drawn into the exhaust gas flow to cool the same. The by-pass damper 136 is normally closed preventing the exhaust gas flow from by-passing the dust collector 38. Opening of the damper 136 allows such by-passing to occur which effectively takes the dust collector 38 out of the system 10. The fifth thermocouple 128 is connected via line 140 to the fan 32, via line 142 to the actuator 28 of the closure cap assembly 22 and via lines 142 and 116 to the furnace afterburner 20. The fifth thermocouple 128 is used to record the dust collector inlet temperature and to cause high temperature shutdown of the system 10 and furnace 12.

Other control components relate to an optional acid control device 144, a current sensor 146 and outlet damper 148, and a control panel 150, pressure sensor 152 and shutoff valves 154. The acid control device 144 can be connected to the second duct 48 upstream of the dust collector 38 to add a dry reagent to neutralize any acids in the exhaust gas flow before they reach the dust collector and damage the bags 92 therein. Normally, such acids are prevented from forming in the gas flow by maintaining the temperature of the flow above the dew point to prevent formation of condensation. Use of the device 144 is primarily to provide added protection against acid formation.

The current sensor 146 and outlet damper 148 allow use of a motor 64 of a smaller horsepower sized to operate the fan 32 for moving air under hot conditions but not under cold conditions at startup. The sensor 146 measures the current being drawn by the motor at cold startup and will close the outlet damper 148 to choke off air flow if the current drawn reaches a present maximum. Choking off air flow reduces the load on the motor and thus protects it from failure.

The control panel 150, pressure sensor 152 and shutoff valves 154 are employed to activate and control cleaning of the bags 92 using the manifold 98, valve 100 and nozzles 102 to pulse pressurized air through the bags, as described earlier. Lower and upper pressure lines 156, 158 are coupled to opposite sides of the bag support plate 94 and thus respectively communicate the pressures prevailing at the exterior and interior of the bags 92 to the pressure sensor 152. If the pressure differential exceeds a predetermined limit, then that indicates that the bags are becoming clogged by the particulates deposited on their exterior surfaces and it is time for initiating a cleaning cycle. The system 10 then goes into the cleaning cycle automatically, activating successively one at a time the shutoff valves 154 to shutdown the collection modules 88 one at a time. Timers (not shown) at the control panel 150 control the duration of the cleaning cycle for each collection module 88. Thus, cleaning of each module 88 is carried out off-line.

Figure 3:
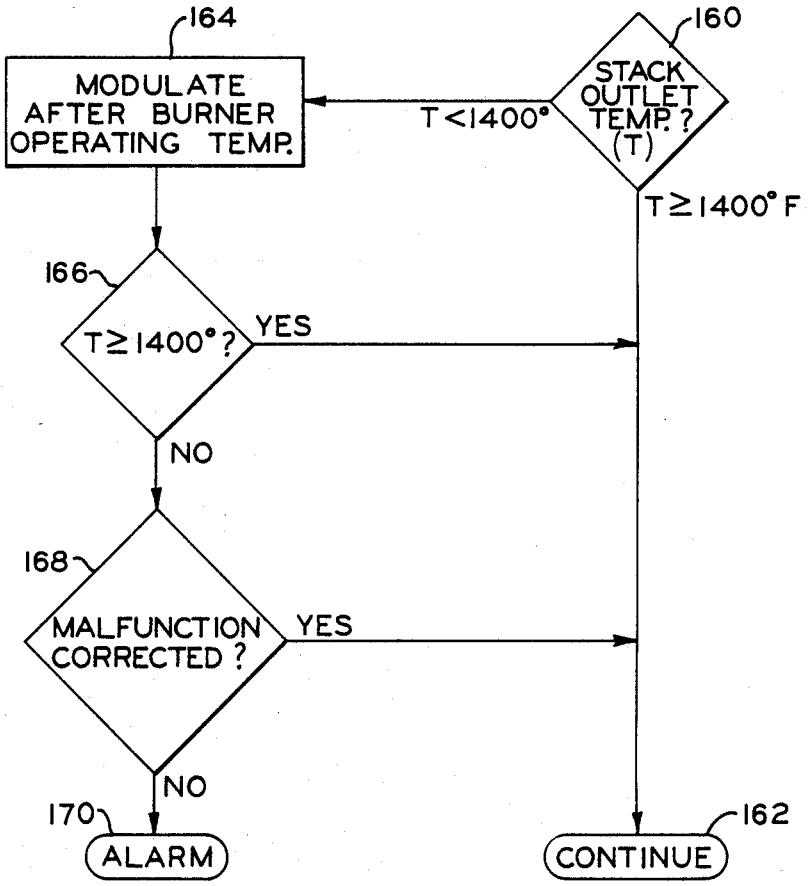
FIGS. 3–5 are flow charts illustrating monitor and control operations of temperature sensing devices of the particulate collection system of FIGS. 1A and 1B.
Figure 4:
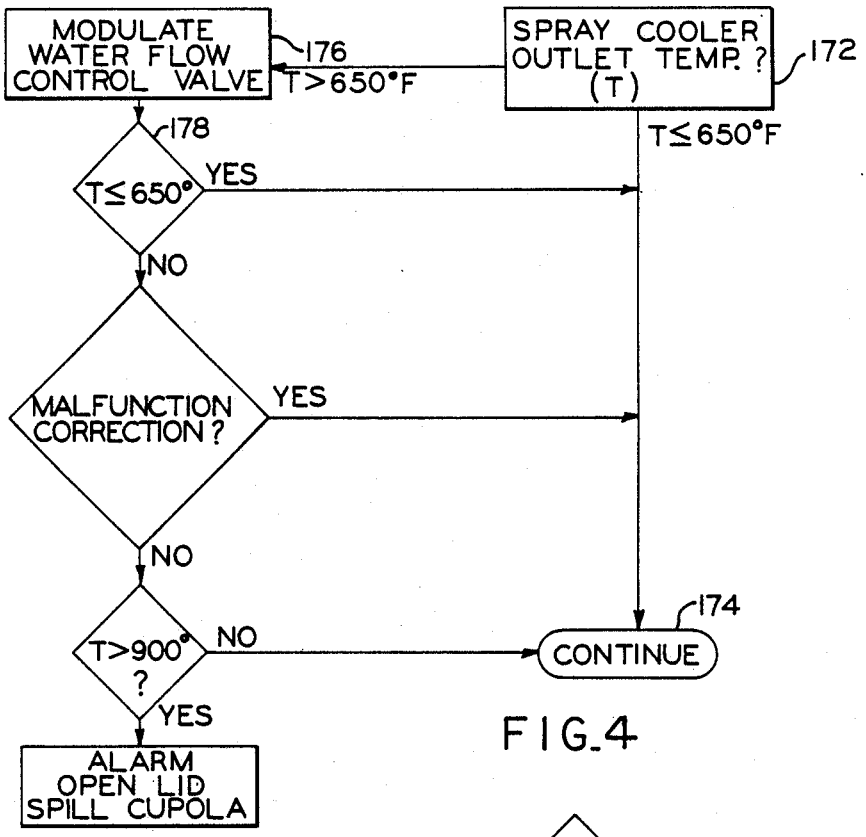
Figure 5:
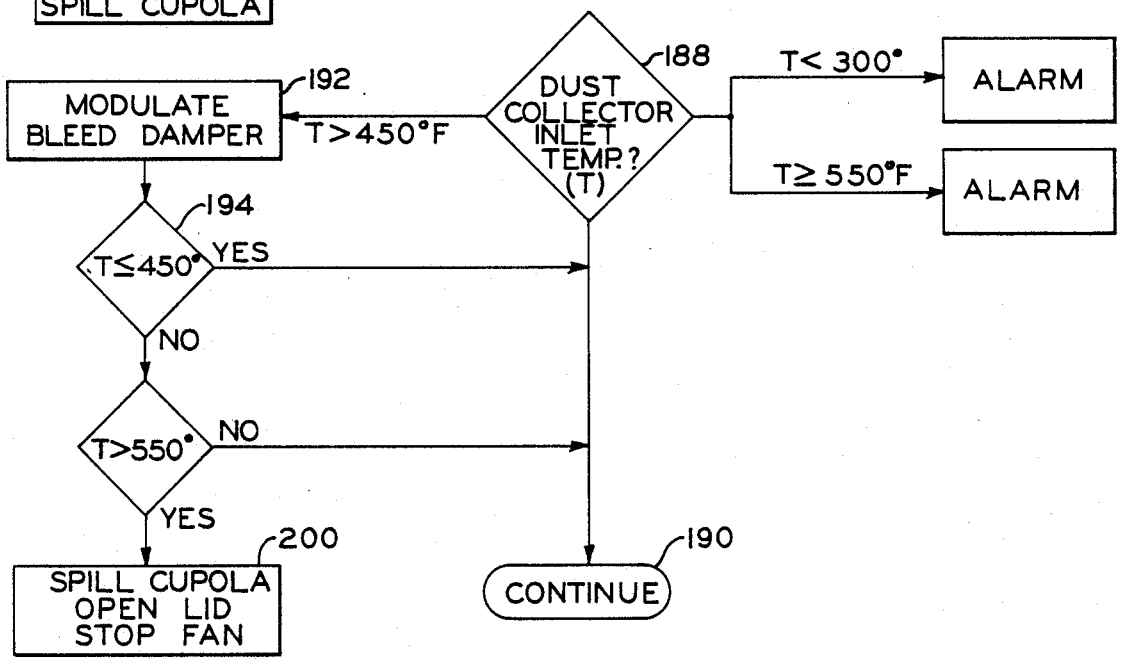

FIGS. 3–5 are flow charts illustrating the monitor and control operations respectively performed and caused by the first to fifth thermocouples 112, 114, 118, 126 and 128 of the particulate collection system 10 in FIGS. 1A and 1B. As mentioned above, in general the thermocouples monitor the temperatures at strategically located points in the exhaust gas flow and cause steps to be taken for regulating the operations of the system 10 and furnace 12 in response to the temperatures sensed by the thermocouples in order to maintain the temperatures within predetermined ranges and to protect the system from temperature-induced damage. Further, upon the occurrence of a malfunction in the system 10, temperature monitoring functions performed by the thermocouples provide an early warning to an operator of possible malfunctions. If the onset of a malfunction is sudden allowing insufficient time for the operator to intervene to correct the problem, the system 10 will respond to cause gas flow to bypass it completely or certain portions thereof to protect them from damage while allotting sufficient time for undertaking an investigation of the malfunction and possible correction thereof without shutdown of the furnace 12 or, alternately, for permitting an orderly shutdown. Such a coordinated and comprehensive approach to temperature control employed by the particulate collection system 10 improves its operational reliability in removing pollutants and safeguards its major separating and collecting devices, the spray cooler 34, spark arrester 36 and dust collector 38, from temperature-induced damage.

Referring first to FIG. 3, there is illustrated a flow chart depicting the monitor and control operations provided by the first and second thermocouples 112, 114 of the collection system 10. As represented by block 160, the thermocouples 112, 114 constantly monitor and sense the temperature of the exhaust gas flow from the furnace exhaust stack 30. If the temperature (T) is approximately equal to or greater than some desired minimum temperature, for instance, 1400° F., then no control action is taken and operation of the system 10 continues normally, as represented by block 162. If the temperature is less than the desired minimum temperature, then as represented by block 164, the operation of the afterburner 20 is modulated or adjusted to bring the temperature above the minimum of 1400° F.

As depicted by block 166, if the adjustment of afterburner operation is successful, then the system 10 continues normally. However, if the adjustment fails to raise the temperature above the minimum, then the operator interprets this to mean that a malfunction has occurred in the afterburner and takes steps to determine what the malfunction is and to correct it, as represented by block 168. If the malfunction can easily be corrected returning the temperature to above the minimum, the system 10 continues normal operation. If the malfunction cannot be readily corrected in a reasonable period of time, an alarm 170 is activated and the system 10 would be shut down to prevent damage to its devices. For example, a minimum temperature of 1400° F. is required to burn off CO produced by the furnace 12 and to maintain the operating temperature of the dust collector 38 above 250° F. for preventing condensation of acids therein which would damage the material of the filter bags 92.

Referring next to FIG. 4, there is shown a flow chart illustrating the monitor and control operations provided by the third thermocouple 118 of the collecting system 10. As identified by block 172, the thermocouple 118 constantly monitors and senses the temperature of the exhaust gas flow from the spray cooler outlet port 46. The thermocouple 118 has two different control or set points which cause different control or preventive measures to take place, for instance, 650° F. and 900° F. If the temperature (T) remains below the first set point, for example, 650° F., then no control measure is taken and operation of the system 10 continues normally, as per block 174.

If the temperature rises above the first set point of 650° F., then as indicated in block 176 the operation of the water flow control valve 124 is modulated or adjusted to increase the cooling water flow and atomizing spray within the spray cooler 34 to bring the temperature down below the first set point. As depicted by block 178, if the adjustment of the valve operation is successful, then the system 10 continues normally. However, if the adjustment fails to lower the temperature below the first set point, then a malfunction has occurred in the valve 124, pump 74 or nozzles 70. If the malfunction can easily be corrected returning the temperature to below the first set point, the system 10 continues normal operation. If the temperature continues to rise above the second set point of 900° F., the control action taken automatically in response to the elevation of the temperature above the second higher set point is to actuate the cylinder 28 to open the furnace closure lid 24 allowing all of the separating and collecting devices of the system 10 to be by-passed. An alarm is sounded and the cupola is spilled.

Referring finally to FIG. 5, there is depicted a flow chart illustrating the monitor and control apparatus provided by the fourth and fifth thermocouples 126, 128 of the collection system 10. As identified by block 188, thermocouple 118 constantly monitors and senses the temperature of the exhaust gas flow at the inlet to the dust collector 38. The thermocouple 126 has two different control or set points which cause different control or preventive measures to take place, for instance, 450° F. and 550° F. If the temperature (T) remains below the first set point, for example 450° F., then no control measure is taken and operation of the system 10 continues normally, as per block 190.

If the temperature rises above the first set point of 450° F., then as indicated in block 192, the operation of the bleed damper 134 is modulated or adjusted to increase the inflow of cooling air into the second duct 48 to mix with the exhaust gas flow upstream of the spark arrester 36 and bring the temperature down below the first set point. As depicted by block 194, if the adjustment of the bleed damper operation is successful, then the system 10 continues normally. However, if the adjustment fails to lower the temperature below the first set point, then the operator can interpret this to mean that a malfunction has occurred somewhere upstream and take steps to determine what the malfunction is and to correct it. If the temperature exceeds a second set point, for example 550° F., the cupola is spilled, cap 24 is opened and fan 32 is stopped, as per block 200.

Alternatively, if the temperature rises above 550° F., bypass damper 136 can be opened, thereby allowing the exhaust gas flow to bypass dust collector 38 and proceed through third duct 54 to duct 60 via the connection therebetween at 138.

Following spilling of the cupola in the event of a total system shutdown, fan 32 is operated at a lower volume, afterburners 20 and spray cooler 34 maintain a temperature of 650° F., for example.

The present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed is:

1. In a temperature-controlled exhaust particulate collection system coupled to a high temperature material processing facility producing a particulate-laden exhaust gas flow and having an afterburner operable at a minimum temperature for combusting gaseous by-products in said exhaust gas flow, said collection system comprising:

a plurality of separating means for receiving said exhaust gas flow from said facility and separating and collecting particulates therefrom prior to release of said exhaust gas flow to the atmosphere;

a plurality of gas flow ducts interconnecting said devices so as to arrange said devices in series and in flow communication with one another and with said exhaust gas flow from said facility;

means for inducing movement of said exhaust gas flow from said facility through said gas flow ducts and said separating and collecting devices;

means coupled to said afterburner of said facility and to one of said ducts for sensing a first temperature of said exhaust gas flow downstream of said facility and upstream of a first one of said devices and for controlling operation of said afterburner in response to the temperature sensed so as to maintain afterburner operation at least at said minimum temperature;

said one of said separating means comprises a spray cooler means for spraying water on the exhaust gas flow as the exhaust gas passes through said cooler means;

means coupled to one of said ducts for sensing a second temperature of the exhaust gas flow downstream of said cooler means and modulating said spray cooler means in response to said sensed second temperature; and another of said separating means comprises a filtering means located downstream of said spray cooler means for filtering particulates from the gas flow.

2. The collection system of claim 1 wherein said filtering means comprises a bag filter apparatus.

3. The collection system of claim 2 and including bleed damper means coupled to one of said ducts for sensing a third temperature of said exhaust gas flow downstream of said facility and upstream of said bag filter apparatus and for adjusting mixing air with the exhaust gas flow to maintain the temperature of the exhaust gas flow below a given level as the exhaust gas flows toward said bag filter apparatus.

4. The collection system of claim 3 including flow diverting means coupled to one of said ducts connected to an inlet of said bag filter apparatus for selectively diverting the exhaust gas flow to bypass said bag filter apparatus, and further temperature sensing means for sensing the temperature of the exhaust gas at the inlet to said bag filter apparatus for causing said flow diverting means to bypass the exhaust gas if said temperature at the inlet exceeds a given level.

5. The collection system of claim 4 wherein another of said devices is a spark arrester means connected to one of said ducts and being located upstream of said bag filter apparatus for precipitating out particulate from said exhaust gas flow.

6. The collection system of claim 5 wherein said spark arrester means is located immediately upstream of said bag filter apparatus.

7. The collection system of claim 2 including flow diverting means coupled to one of said ducts connected to an inlet of said bag filter apparatus for selectively diverting the exhaust gas flow to bypass said bag filter apparatus, and further temperature sensing means for sensing the temperature of the exhaust gas at the inlet to said bag filter apparatus for causing said flow diverting means to bypass the exhaust gas if said temperature at the inlet exceeds a given level.

8. In a temperature-controlled exhaust particulate collection system coupled to a high temperature material processing facility producing a particulate-laden exhaust gas flow and having an afterburner operable at a minimum temperature for combusting gaseous by-products in said exhaust gas flow, said collection system comprising:

a plurality of devices for receiving said exhaust gas flow from said facility and separating and collecting particulates therefrom prior to release of said exhaust gas flow to the atmosphere, one of said devices including a plurality of filter bags;

a plurality of gas flow ducts interconnecting said devices so as to arrange said devices in series and in flow communication with one another and with said exhaust gas flow from said facility;

means coupled in flow communication to one of said ducts upstream of said one device having said filter bags and being operable for permitting entering and mixing of a cooling gas into said exhaust gas flow to reduce the temperature thereof;

means for inducing movement of said exhaust gas flow from said facility through said gas flow ducts and said separating and collecting devices; and means coupled to one of said ducts for sensing the temperature of said exhaust gas flow downstream of said facility and upstream of said one device having said bag filters and for controlling operation of said cooling gas entering and mixing means to permit said cooling gas to enter and mix with said exhaust gas flow to reduce the temperature thereof in response to the temperature sensed being above a preset maximum temperature.

9. The collection system as recited in claim 8 wherein said gas entering and mixing means is an air bleed damper.

10. The collection system as recited in claim 8 wherein:

said one device having said filter bags is a dust collector;

another of said devices being located immediately upstream of said dust collector is a spark arrester;

said one of said ducts to which said temperature sensing means is coupled interconnects said spark arrester to said dust collector; and said one of said ducts to which said gas entering and mixing means is coupled is connected to and located upstream of said spark arrester.

11. The collection system as recited in claim 8 further comprising:

flow diverting means coupled to the one of said ducts connected to an inlet of said one device having said filter bags and being operable for permitting said exhaust gas flow to bypass said one device; and said temperature sensing means also controlling operation of said flow diverting means to permit said exhaust gas flow to bypass said one device having said filter bags in response to the temperature sensed being above said preset maximum temperature.

12. The collection system as recited in claim 11 wherein said flow diverting means is a bypass damper.

13. The collection system of claim 8 including flow diverting means for selectively directing the exhaust gas flow to bypass at least a portion of said system and further temperature sensing means for sensing the temperature of the exhaust gas at the inlet to said device having bag filters for causing said flow diverting means to bypass the exhaust gas if said temperature at the inlet exceeds a given level.

14. In a temperature-controlled exhaust particulate collection system coupled to a high temperature material processing facility producing a particulate-laden exhaust gas flow, said collection system comprising:

a plurality of devices for receiving said exhaust gas flow from said facility and separating and collecting particulates therefrom prior to release of said exhaust gas flow to the atmosphere, one of said devices including a plurality of filter bags;

a plurality of gas flow ducts interconnecting said devices so as to arrange said devices in series and in flow communication with one another and with said exhaust gas flow from said facility;

one of said devices comprising a spray cooler means for spraying water on said exhaust gas flow to reduce the temperature of said exhaust gas flow and to remove larger particulates;

means for inducing movement of said exhaust gas flow from said facility through said gas flow ducts and said separating and collecting devices;

means coupled to one of said ducts for sensing the temperature of said exhaust gas flow downstream of said facility and upstream of said one device having said bag filters and for controlling operation of said flow inducing means to terminate the same in response to the temperature sensed being above a preset maximum temperature; and one of said devices comprising a bleed damper means including means for mixing cooler air with said exhaust gas flow in response to the exhaust gas temperature.

15. The collection system of claim 14 wherein another of said devices is a spark arrester means for separating ignited particulate out of the exhaust gas flow, said spark arrester means located immediately upstream of said filter bags.

16. The collection system as recited in claim 14 wherein said flow inducing means is a fan.

17. The collection system as recited in claim 14 further comprising:

means operable for opening an exhaust end of said facility located upstream of a first one of said devices to permit said exhaust gas flow to bypass all of said devices; and said temperature sensing means also controlling operation of said facility exhaust end opening means to permit said exhaust gas flow to bypass all of said devices in response to the temperature sensed being above said preset maximum temperature.

18. The collection system as recited in claim 17 wherein said opening means is a closure cap assembly pivotally mounted on said facility exhaust end.

19. In a temperature-controlled exhaust particulate collection system coupled to a high temperature material processing facility producing a particulate-laden exhaust gas flow, said collection system comprising:

a plurality of devices for receiving said exhaust gas flow from said facility and separating and collecting particulates therefrom prior to release of said exhaust gas flow to the atmosphere, a first one of said devices being a spray cooler located immediately downstream of said facility;

another of said devices being a bag filtering apparatus located downstream of said spray cooler;

means connected to said spray cooler and being operable for supplying a cooling fluid thereto and for spraying the same on said exhaust gas flow as it passes through said spray cooler;

a plurality of gas flow ducts interconnecting said devices so as to arrange said devices in series and in flow communication with one another and with said exhaust gas flow from said facility;

means for inducing movement of said exhaust gas flow from said facility through said gas flow ducts and said separating and collecting devices;

means coupled to one of said ducts for sensing the temperature of said exhaust gas flow immediately downstream of said spray cooler and for controlling operation of said cooling fluid supplying and spraying means in response to the temperature sensed being above a preset maximum temperature; and means operable for opening an exhaust end of said facility located upstream of said spray cooler to permit said exhaust gas flow to bypass all of said devices;

said temperature sensing means also controlling operation of said facility exhaust end opening means to permit said exhaust gas flow to bypass all of said devices in response to the temperature sensed being above a second preset maximum temperature being higher than said preset maximum temperature.

20. The collection system as recited in claim 19 wherein said opening means is a closure cap assembly pivotally mounted on said facility exhaust end.

21. In a temperature-controlled exhaust particulate collection system coupled to a high temperature material processing facility producing a particulate-laden exhaust gas flow, said collection system comprising:

a plurality of devices for receiving said exhaust gas flow from said facility and separating and collecting particulates therefrom prior to release of said exhaust gas flow to the atmosphere;

a plurality of gas flow ducts interconnecting said devices so as to arrange said devices in series and in flow communication with one another and with said exhaust gas flow from said facility;

a fan for inducing movement of said exhaust gas flow from said facility through said gas flow ducts and said separating and collecting devices;

an electric motor for powering said fan;

means operable for regulating exhaust gas flow at an outlet of said fan; and means coupled to said motor for sensing the electrical load on said motor in operating said fan and coupled to said flow regulating means for controlling operation of said flow regulating means in response to the load sensed to regulate exhaust gas flow through said fan outlet to prevent overload of said motor at cold startup of said fan.

* * * * *